US005135435A

United States Patent [19]

Rasmussen

[11] Patent Number: 5,135,435

[45] Date of Patent: Aug. 4, 1992

[54] SYSTEM FOR TRANSPORTING AND STACKING COINS

[75] Inventor: James M. Rasmussen, Chicago, Ill.

[73] Assignee: Cummins-Allison Corp., Mt. Prospect, Ill.

[21] Appl. No.: 268,336

[22] Filed: Nov. 7, 1988

[51] Int. Cl.[5] ..... G07D 9/06; B65B 35/24

[52] U.S. Cl. ..... 453/56; 53/532; 198/626.3; 198/631; 198/803.8; 198/861.2; 414/794.5; 453/61

[58] Field of Search ..... 453/31, 32, 56, 61; 53/212, 254, 532, 541; 414/794.5, 794.6; 198/626, 627, 631, 803.8, 819, 861.2, 626.3

[56] References Cited

U.S. PATENT DOCUMENTS

| | | | |
|---|---|---|---|
| 984,522 | 2/1911 | Altschul . | |
| 2,658,630 | 11/1953 | Melin | 414/794.5 X |
| 2,660,432 | 11/1953 | Wilske et al. | 414/794.5 X |
| 3,120,892 | 2/1964 | Henning et al. | 198/803.8 |
| 3,175,563 | 3/1965 | Simmerman et al. | 198/626 X |
| 3,213,719 | 10/1965 | Kloack | 81/71 |
| 3,340,882 | 9/1967 | Holmes et al. . | |
| 3,550,350 | 12/1970 | McCollough et al. | 53/167 |
| 3,631,649 | 1/1972 | Close et al. | 53/3 |
| 3,704,566 | 12/1972 | Zimmerman | 53/30 |
| 3,772,972 | 11/1973 | Dutro et al. | 414/794.5 X |
| 3,940,946 | 3/1976 | Anderson | 64/8 |
| 4,080,079 | 3/1978 | Waara | 403/57 |
| 4,098,056 | 7/1978 | Ozaki | 53/212 |
| 4,102,110 | 7/1978 | Iizuka et al. | 53/59 R |
| 4,246,811 | 1/1981 | Bondhus et al. | 81/436 |
| 4,422,541 | 12/1983 | Lisec | 198/627 |
| 4,515,172 | 5/1985 | Nakamura et al. . | |

OTHER PUBLICATIONS

*IBM Technical Disclosure Bulletin*, vol. 8, No. 6, Nov. 6, 1965, p. 896, Rembecki, J. S., "Conveyor Belt".

*Primary Examiner*—F. J. Bartuska

*Attorney, Agent, or Firm*—Arnold, White & Durkee

[57] ABSTRACT

A coin transporting and stacking mechanism transports coins between two endless belts which form a coin transporting channel. The coins are gripped on diametrically opposed edges by the counter-rotating belts, and securely held as they travel towards the coin ejecting end of the channel. The coin ejecting end moves vertically to stack ejected coins one on top of the other to form a coin stack suitable for automtic wrapping. The mechanism is capable of transporting and stacking coins in a relatively small space due the movable, flexible transporting channel. Moreover, the mechanism requires fewer parts than conventional coin transporting and stacking systems to enhance reliability.

69 Claims, 6 Drawing Sheets

SYSTEM FOR TRANSPORTING AND STACKING COINS

BACKGROUND OF THE INVENTION

1. Field of the Invention

This invention relates generally to coin handling equipment, and more particularly to a mechanism for transporting and stacking coins.

2. Description of the Related Art

Coin handling equipment, particularly coin transporting and packaging equipment, is usually complex. The complexity stems from an abundance of individual parts and mechanisms conventionally used to process coinage in various ways. For instance, a comprehensive coin handling machine may include a coin sorter, a coin stacker, a coin wrapper, and means for transporting coins throughout the machine. These machines commonly contain hundreds of interrelated parts and mechanisms. Exemplary coin handling machines of this type are shown in U.S. Pat. Nos. 3,340,882 issued Sep. 12, 1967 to Holmes et al.; and U.S. Pat. No. 4,102,110 issued Jul. 25, 1978 to Iisuka et al. Probability generally shows that as the number of parts of a machine increases, the reliability of the machine decreases. Not surprisingly, machines of this type which are in commercial use today have been found to require frequent service.

Traditional coin handling machines use a variety of devices for transporting and stacking coins. The devices include chain drives, conveyors, guide chutes, clamping mechanisms, guide tubes, spring-loaded channels, roller guides, and combinations thereof. The efficiency, controllability, and complexity of these devices vary. For instance, guide chutes offer simple construction, but exhibit poor control over coins, while chain drives control coins better, but at the cost of additional complexity. However, simple guide chutes, for example, may introduce additional complexity elsewhere in the machine due to their poor coin controllability.

SUMMARY OF THE INVENTION

It is a primary object of the present invention to provide a coin transporting and stacking mechanism which uses considerably fewer parts than conventional coin handling mechanisms.

It is an important object of the present invention to provide a coin handling mechanism that operates quickly and reliably.

It is another object of the present invention to provide a coin transporting and stacking mechanism which automatically stacks a preselected number of coins.

It is still another object of the present invention to provide a coin transporting and stacking mechanism that is controllable and efficient.

It is a further object of the present invention to provide a coin transporting and stacking mechanism that is small in size when compared with conventional coin handling mechanisms of this type.

In accordance with the present invention, the foregoing objects are realized by an apparatus for transporting coins which includes first and second endless belts mounted on respective pairs of pulleys. Each of the belts has a coin engaging portion. The coin engaging portion of one belt is substantially parallel to the coin engaging portion of the other belt, thus forming a coin transporting channel therebetween. The coin transporting channel has a coin receiving end and a coin ejecting end, and each belt has an outwardly facing slot therein, thus allowing the belts to grip diametrically opposed edges of a coin in the coin transporting channel. The apparatus also includes a means for counter-rotating the endless belts, whereby the belts converge on a coin to be transported at the coin receiving end of the coin transporting channel, grip the diametrically opposed edges of the coin, transport the coin between the belts from the coin receiving end to the coin ejecting end of the coin transporting channel, and eject the coin at the coin ejecting end of the coin transporting channel.

As one way to provide a stacking operation, the coin transporting apparatus further includes means for moving the coin ejecting end of the coin transporting channel in a direction transverse to the parallel coin engaging portions of the belts which form the coin ejecting end of the coin transporting channel. The coin ejecting end of the coin transporting channel is moved by a first predetermined distance to facilitate stacking of coins as they are ejected from the coin ejecting end. Upon completion of a stack, the coin ejecting end of the coin transporting channel is moved in the opposite direction by a second predetermined distance, thus being repositioned to begin another stack. Because the belts control and quickly transport the coins, and are easily movable during the stacking operation, they provide a simple, reliable solution to the problems of conventional coin handling systems

BRIEF DESCRIPTION OF THE DRAWINGS

Other objects and advantages of the invention will become apparent upon reading the following detailed description and upon reference to the drawings in which.

DESCRIPTION OF THE PREFERRED EMBODIMENT

Figure 1:
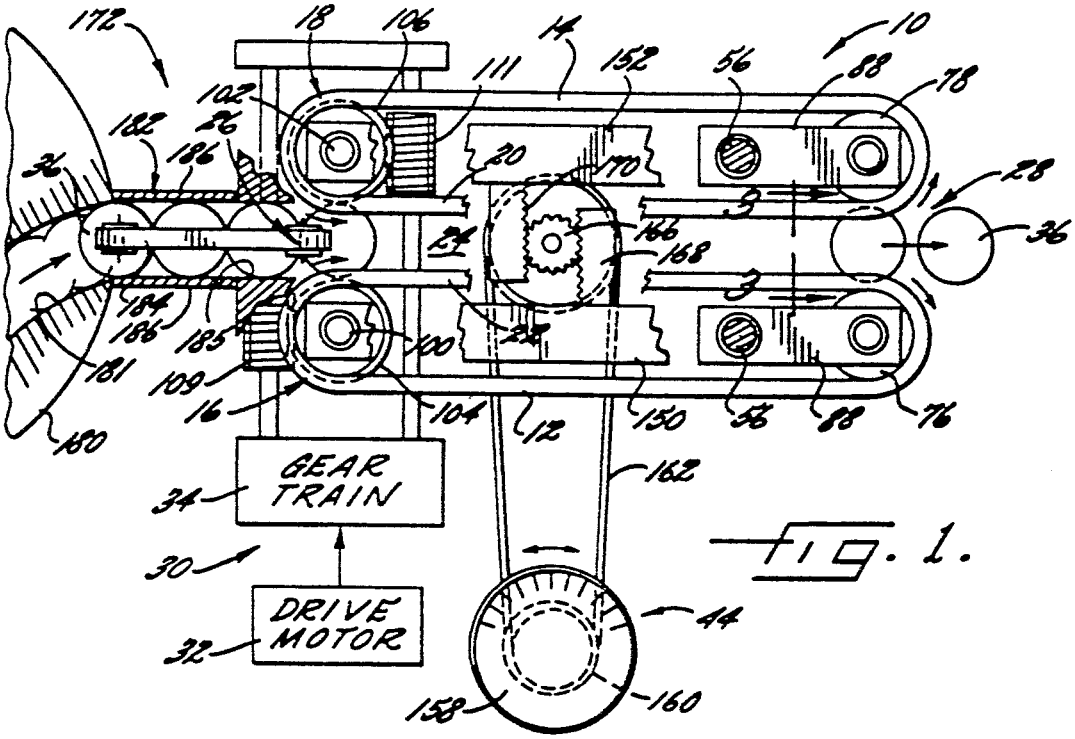
FIG. 1 is a schematic illustration of a coin transporting mechanism embodying the present invention.

While the invention is susceptible to various modifications and alternative forms, specific embodiments thereof have been shown by way of example in the drawings and will be described in detail herein. It should be understood, however, that it is not intended to limit the invention to the particular forms disclosed, but, on the contrary, the intention is to cover all modifications, equivalents, and alternatives falling within the scope of the invention as defined by the appended claims.

Figure 2:
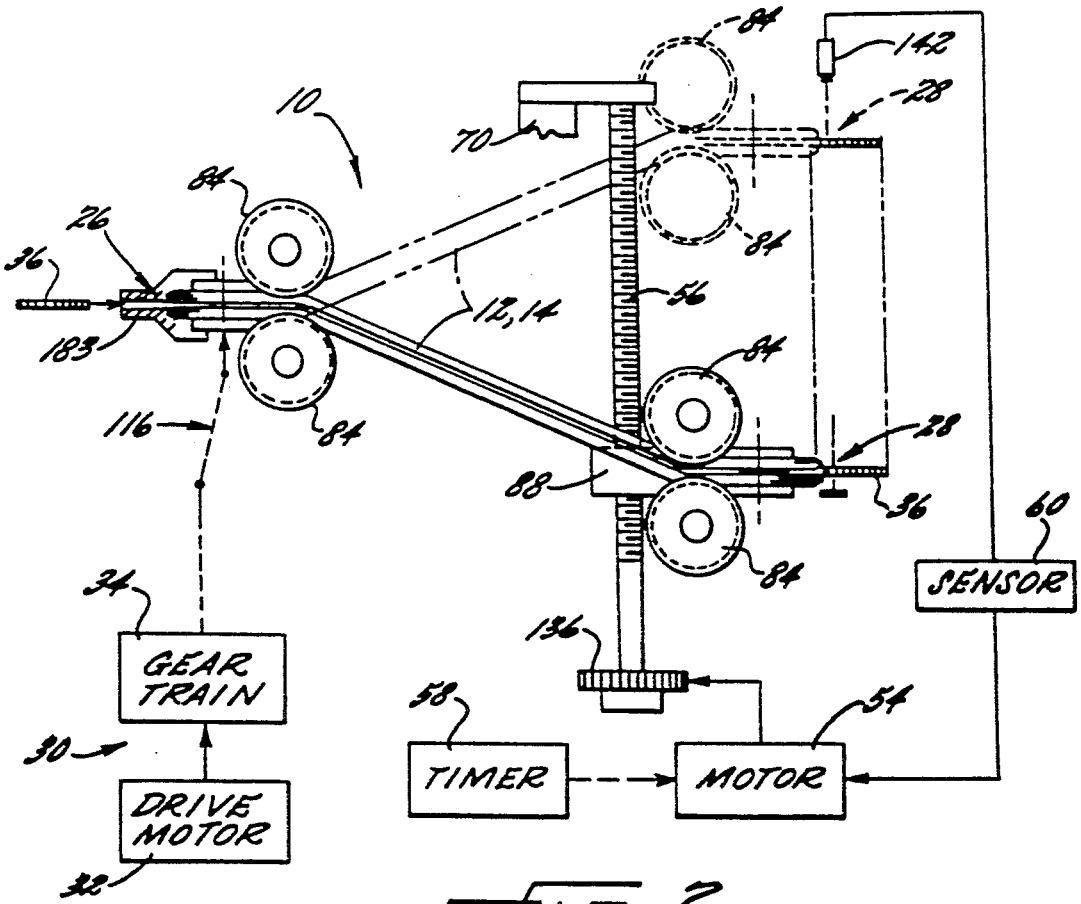
FIG. 2 is a schematic illustration of a coin transporting and stacking mechanism embodying the present invention.
Figure 3:
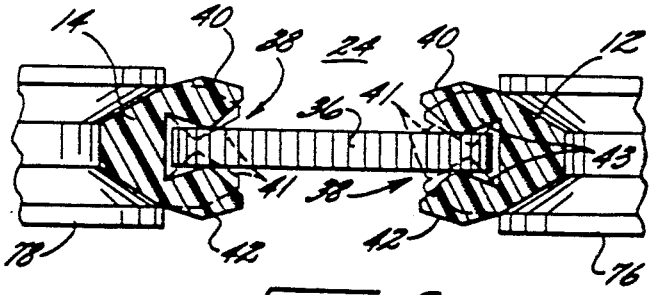
FIG. 3 is a sectional view of an endless belt taken along line 3—3 in FIG. 1.
Figure 4:
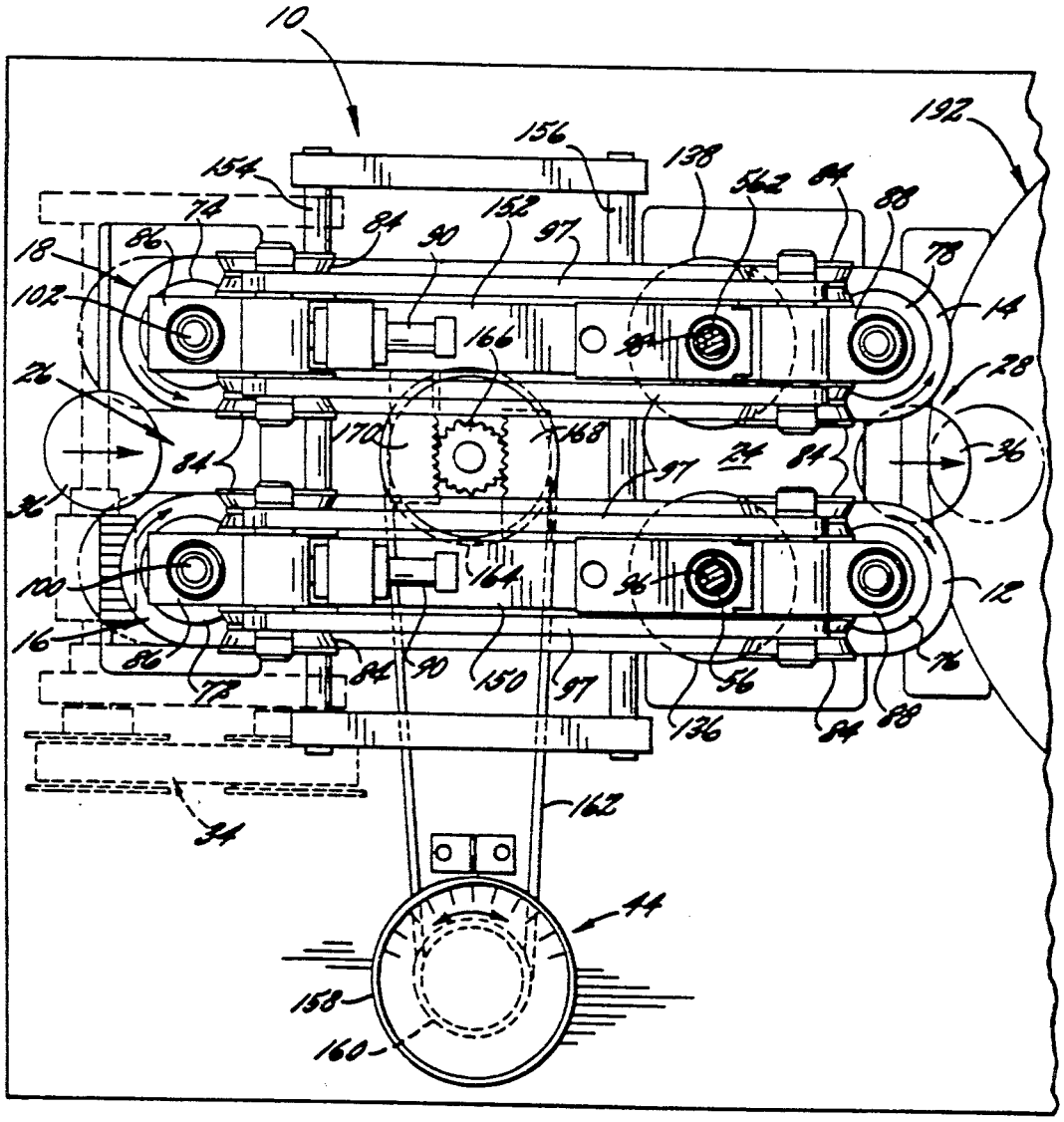
FIG. 4 is a top plan view of a preferred embodiment of a coin transporting and stacking mechanism embodying the present invention.
Figure 5:
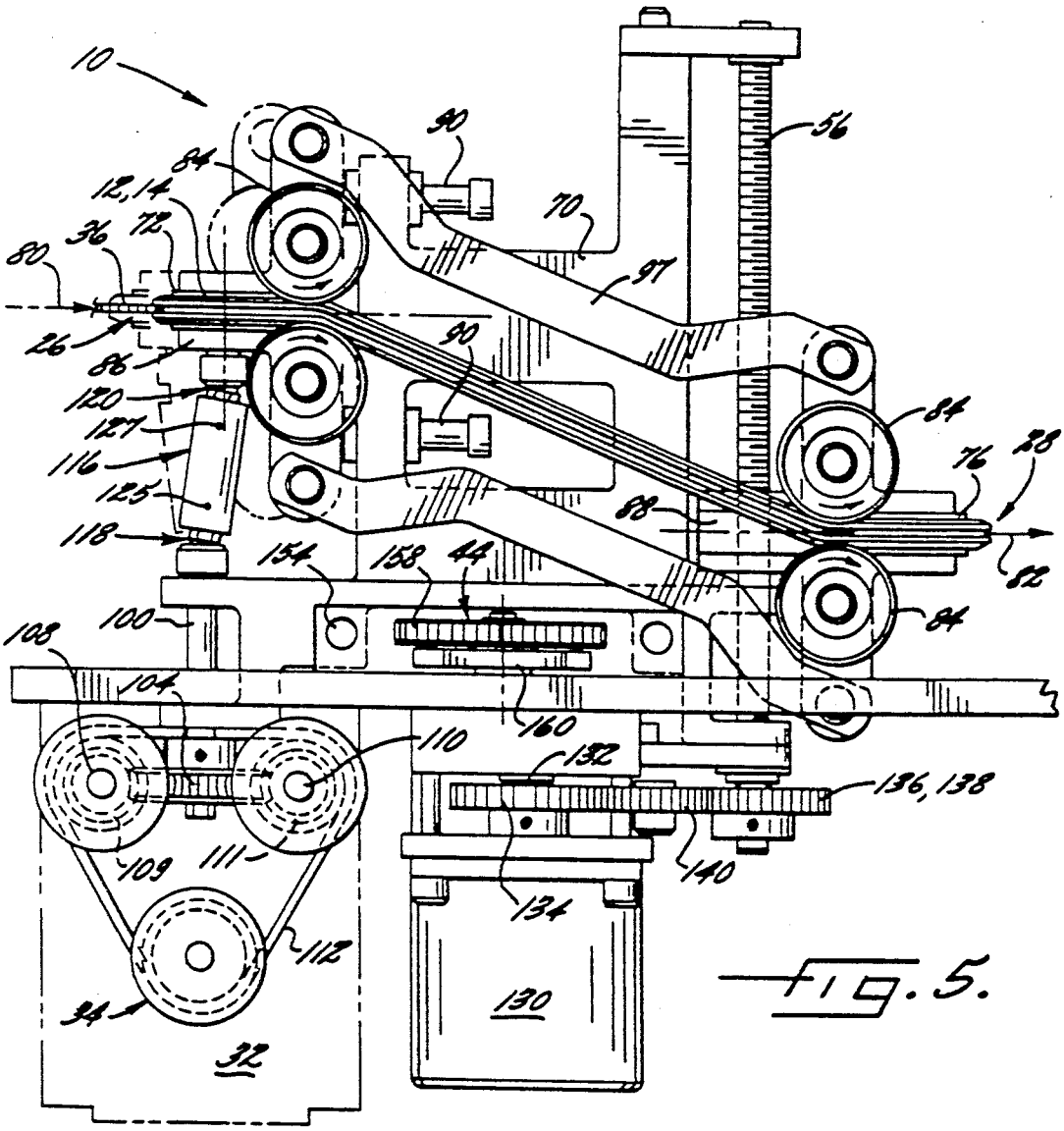
FIG. 5 is a side plan view of a preferred embodiment of a coin transporting and stacking mechanism embodying the present invention.

FIGS. 1–3 illustrate general concepts of the present invention, while FIGS. 4–10 illustrate particular mechanisms embodying the present invention.

Referring initially to FIG. 1 wherein a coin transporting mechanism 10 is illustrated, a first endless belt 12 is mounted on a first pair of pulleys 16, and a second endless belt 14 is mounted on a second pair of pulleys 18. Each of the belts 12,14 has a respective coin engaging portion 20,22. The coin engaging portions 20,22 of each belt 12,14 are substantially parallel to one another and form a coin transporting channel 24 therebetween. The coin transporting channel 24 includes a coin receiving end 26 and a coin ejecting end 28. A drive motor 32 and gear train 34 counter-rotate the endless belts 12,14 so that the belts 12,14 transport a coin 36 between the belts 12,14 from the coin receiving end 26 to the coin ejecting end 28 of the coin transporting channel 24. Counter-rotation of the belts 12,14 causes the belts 12,14 to rotate in the opposite sense, i.e., the first belt 12 rotates clockwise while the second belt rotates counterclockwise. Therefore, the coin engaging portions 20,22 of each belt 12,14 travel along the coin transporting channel 24 in the same general direction. Preferably the belts 12,14 rotate at substantially the same rate so that the coin 36 moves along the coin transporting channel 24 with little movement relative to the belts 12,14.

The belts 12,14 engage diametrically opposed edges of a coin 36 in the coin transporting channel 24, and preferably transport the coin 36 with the coin 36 lying in substantially the same plane as the centerlines of the belts 12,14. For this purpose, each belt 12,14 advantageously has an outwardly facing slot 38, as shown in FIG. 3, adapted to receive edges of a coin 36. Each slot 38 forms a pair of resilient legs 40,42 which grip an upper and lower edge of the coin as it enters the slot 38. Preferably, the slotted belts 12,14 are made of polyurethane having a durometer between fifty and one hundred. In the coin transporting channel 24 the slots 38 face one another, so that a coin entering the coin receiving end 26 of the channel 24 is gripped on diametrically opposed edges by the legs 40,42 as the belts 12,14 converge. As the belts 12,14 continue to counter-rotate, the coin 36 moves securely along the coin transporting channel 24 toward the coin ejecting end 28 where the coin 36 is ejected as the belts 12,14 diverge and release the coin 36, as will be described in greater detail in reference to FIGS. 9 and 10. Alternatively, V-slotted belts may be used to frictionally hold a coin 36 between the coin engaging portions 20,22 of the belts 12,14 in the coin transporting channel 24.

A width adjustor 44 is provided for controllably varying the width of the coin transporting channel 24. The width of the coin transporting channel 24 is varied to allow coins of different denominations, i.e., different diameters, to be transported along the channel 24. When a coin 36 is to be transported by its diametrically opposed edges, the width of the coin transporting channel is adjusted responsive to the diameter of the coin. For instance, the width adjustor 44 controllably varies the width of the coin transporting channel 24 from a first width for transporting coins of a first preselected diameter to a second width for transporting coins of a second preselected diameter. Preferably, the width adjustor 44 can vary the width of the coin transporting channel 24 to accommodate coins of all denominations within a particular currency system.

Refer now to FIG. 2, wherein a coin transporting and stacking mechanism is illustrated schematically as a side view of FIG. 1. The coin transporting mechanism 10 of FIG. 1 is shown to further include a motor 54 and a threaded or helical guide shaft 56 for moving the coin ejecting end 28 in a direction substantially perpendicular to the parallel coin engaging portions 20,22 of the belts 12,14 which form the coin ejecting end 28. The direction of movement is shown in solid and phantom lines. The shaft 56 moves and guides the coin ejecting end 28 in response to rotation by the motor 54. Controllably moving the coin ejecting end 28 in response to a predetermined number of coins being ejected from the coin ejecting end 28 causes successively ejected coins to be stacked on top of one another as the coin ejecting end 28 is moved upwardly, as shown by the phantom lines.

A control signal initiates movement of the coin ejecting end 28. The control signal may be sent from a timer 58, for a synchronous coin stacking system, or from a sensing means 60, for an asynchronous coin stacking system. A sensing means 60 is preferably adjusted to sense a coin being ejected from the coin ejecting end 28 of the coin transporting channel 24, and to deliver a signal in response thereto. Of course, other events may be related to a coin being ejected, and, therefore, may be sensed as an indication thereof. For instance, a coin entering the coin receiving end 26 travels to the coin ejecting end 28 in a time governed by the speed of the belts 12,14.

For best results when stacking coins, the coin ejecting end 28 is moved a first predetermined distance in response to a signal from the sensing means 60 or from the timer 58. Preferably the first predetermined distance is substantially equal to or slightly greater than the thickness of the coins being stacked. After completing a stack, the coin ejecting end 28 is preferably moved a second predetermined distance in the opposite direction so that it is in position to begin another stack. Alternatively, the coin ejecting end 28 of the coin transporting channel 24 can be moved at a first continuous rate during the stacking operation, and at a second continuous rate during repositioning.

The general concepts described with reference to FIGS. 1–3 will now be described in greater detail with reference to FIGS. 4–8 wherein a coin transporting and stacking mechanism 10 is illustrated. A succession of coins 36 is delivered to the coin receiving end 26 where counter-rotating belts 12,14 mounted on respective pairs of pulleys 16,18 converge to grip the coins. Respective first pulleys 72,74 which form the coin receiving end 26 are aligned adjacent one another on a first support 86, and rotate in a first substantially horizontal plane 80. As successive coins are gripped by the belts 12,14, the belts carry the coins 36 along the coin transporting channel 24 to the coin ejecting end 28 formed by respective second pulleys 76,78 which are aligned adjacent one another on a second support 88, and rotate in a second substantially horizontal plane 82. At the coin ejecting end 28, the coins 36 are released when the belts 12,14 diverge from each other as the belts curl around the pulleys 76,78.

A drive motor 32 drives a gear train 34 which counterrotates the belts 12,14. The drive motor 32 drives a first shaft 108 and second shaft 110 via a belt and pulley arrangement 112. The belt and pulley arrangement 112 rotates each shaft 108,110 in the same direction as the drive motor 32 (See FIGS. 1 and 4). A worm 109,111 carried by each shaft 108,110 meshes with a worm gear 104,106 carried at the end of each drive shaft 100,102, respectively. The shafts 108,110 are positioned on opposite sides of the worm gears 104,106, so that when the respective worm gears mesh, the drive shafts 100,102 are rotated in opposite directions. In addition to counter-rotating the belts 12,14, the worm drive also provides a gear reduction so that the belts 12,14 rotate at a slower speed than the motor 32.

In order to grip the coins so that they can be easily carried along the coin transporting channel 24, the endless belts 12,14 have an outer surface defined by a pair of outwardly extending, resilient legs 40,42 formed by a slot 38 (See FIG. 3). When a coin is initially engaged by the converging belts 12,14, diametrically opposite edges of the coin engage the opposed outer surfaces of the legs 40,42. A coin 36 engaged by each belt 12,14 contacts the surfaces 41 of a coin receiving portion of each belt which guide the coin 36 into a coin retaining portion of each belt. Since the coin is thicker than the narrowest portion of the coin receiving portion of the slot, the legs 40,42 are forced apart. As the legs 40,42 open, the coin contacts the coin retaining surfaces 43 which frictionally hold the coin 36 by its upper and lower edges due to the pinching force applied by the resilient legs 40,42.

To perform a stacking operation, the coin ejecting end 28 moves vertically along a pair of rotating helical guide shafts **56,56*a* as it deposits coins. This vertical movement of the pulleys 76,78 causes successive coins to be ejected at successively increasing elevations so that each coin is deposited on top of the preceding coin, thereby forming the desired coin stack. The second support 88 has a pair of threaded openings 96,98 adapted to engage the helices or threads of the respective guide shafts 56,56*a*. As the guide shafts 56,56*a* rotate, the second support 88 rides along the helices thus raising or lowering the second pulleys 76,78. A plurality of guide rollers 84 are rotatably mounted adjacent each pulley 72,74,76,78 for guiding the belts 12,14 onto their respective pulleys. As the second pulleys 76,78 move vertically to perform the coin stacking operation, the guide rollers act to ensure contact of each belt 12,14** with the respective pulleys to prevent slippage.

Preferably, a stepper motor 130 rotates the helical guide shafts **56,56*a*. The stepper motor 130 has an output shaft 132 which carries a gear 134. The stepper motor's gear 134 drives an intermediate gear 140 which in turn drives a pair of gears 136,138 carried by the guide shafts 56,56*a*. Rotation of the guide shafts 56,56*a* causes the second support 88** to move vertically, as described previously.

Figure 6:
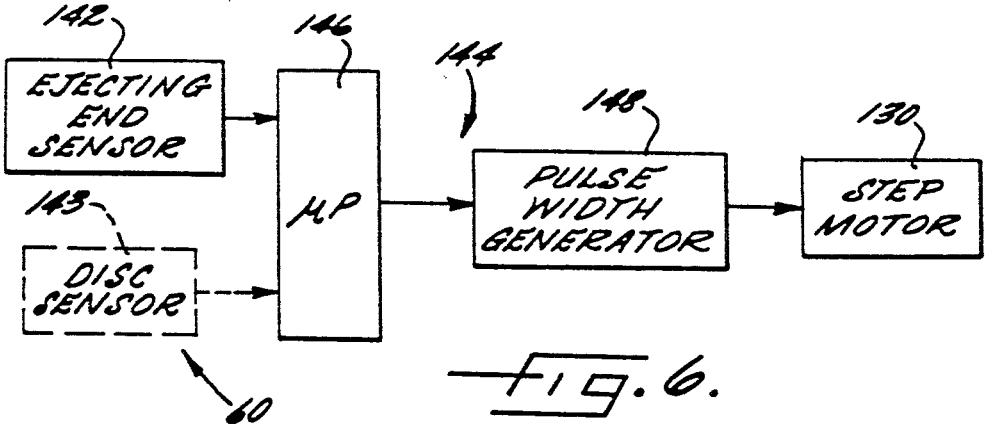
FIG. 6 is a block diagram of a preferred embodiment of an electronic control.

To control the rate of vertical movement of the coin ejecting end 28, an optical sensor arrangement 142 positioned near the coin ejecting end 28 of the channel 24 delivers a signal in response to a coin traveling past it. Preferably, the optical sensor arrangement 142 is positioned to pass a sensing beam through the coin ejecting end 28 of the channel 24, as shown in FIG. 2. As a coin passes the optical sensor, it breaks the sensing beam which causes the sensor to deliver a signal. As illustrated in FIG. 6, a signal processor 144 receives the signal, and delivers a control signal to the stepper motor 130 to regulate its rotation. The signal processor 144 controls the rotation of the stepper motor 130 in response to the number of signals received from the sensor 142. The sensor signal impinges on a microprocessor 146 under software control which counts the number of received signals. If the count is less than a predetermined count, which corresponds to a full stack of coins, a pulse width generator 148 delivers a signal to the stepper motor 130 causing it to rotate by a first predetermined amount. The first predetermined amount of rotation causes the coin ejecting end 28 to be incrementally raised by an amount substantially equal to the thickness of the coin being stacked. For instance, a dime has a thickness of 0.053". For every dime ejected onto the stack, the ejecting end raises by 0.055" to give the next dime space to eject. If one turn of the stepper motor 130 corresponds to a 0.5" vertical movement of the coin ejecting end 28, then the stepper motor 130 rotates by 39.6 degrees each time a dime is ejected. If the count is greater than or equal to the predetermined count, the pulse width generator 148 delivers a signal to the stepper motor 130 causing it to rotate by a second predetermined amount. The second predetermined amount causes the coin ejecting end 28 to be lowered to a starting position where the next coin stack will begin.

To prevent stretching of the belts 12,14 by movement of the coin ejecting end 28, the first and second supports 86,88 are connected to one another by eight pivoting linkage arms 97 connected to the supports 86,88 by respective pins 99. Since the coin ejecting end 28 follows the guide shafts **56,56*a* to provide a vertically aligned coin stack, the first support 86 is mounted so that it moves horizontally on guide rods 90 in response to vertical movement of the coin ejecting end 28. The slidable rods 90 fix the first support 86 horizontally to keep the first pulleys 72,74 in a first substantially horizontal plane 80 while allowing for one-dimensional movement within the first horizontal plane 80**.

To allow the first pair of pulleys 72,74 to be driven as the first support 86 moves, each drive shaft 100,102 includes a universally mounted section 116. The construction of only one drive shaft will be discussed with the understanding that both are so constructed. The section 116 is mounted on its ends by universal joints 118,120 to allow the first support 86 to move horizontally along the rods 90. When the distance between the planes 80,82 decreases as the coin ejecting end 28 is raised from the bottom, the linkage arms 97 slide the first support 86 along the rods 90 away from the frame 70 to keep a predetermined amount of tension on the belts 12,14. When the distance between the planes 80,82 increases as the coin ejecting end 28 is raised higher than the coin receiving end 26, the linkage arms 97 pull the first support 86 towards the frame 70. If a rigid drive shaft is used, as the coin ejecting end 28 of the coin transporting channel 24 moves vertically, the distance changes between the first pulleys 72,74 and the second pulleys 76,78. Increasing the distance between the first horizontal plane 80 and the second horizontal plane 82 could cause the belts 12,14 to stretch, absent a means for allowing horizontal movement of the coin receiving end 26. The useful life of the belts 12,14 may shorten if subjected to this type of fatigue.

Figure 7:
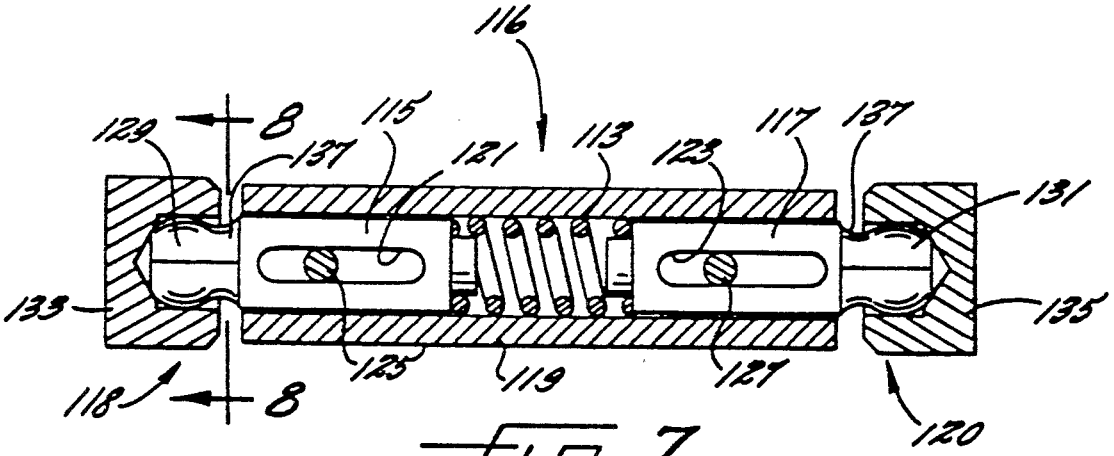
FIG. 7 is a cross sectional view of a portion of a drive shaft.

A cross sectional view of the universal section 116 of the drive shaft 100,102 is shown in FIG. 7. As the first support 86 slides horizontally along the rods 90, the universal section 116 stretches and contracts so that it remains in driving contact with the universal joints 118,120. A spring 113 biases two opposing shaft portions 115,117 apart to allow the universal section 116 to move axially. The axial movement not only keeps the drive shaft in contact with the universal joints, but also allows for ease of removal, so that the drive shaft may be easily replaced without disassembly of the device. To link the shaft portions 115,117 together for mutual rotation, a tubular housing 119 is disposed about the spring 113 and the shaft portions 115,117. As shown, each shaft portion 115,117 has a slot 121,123 therethrough, and a pin 125,127, which is fixed to the housing 119, extends through each respective slot 121,123. The slot and pin configuration serves two functions: it limits the axial movement of the opposing shaft portions 115,117, and it rigidly links one shaft portion 115 to the other 117 so that rotational motion is transferred from one end of the universal section 116 to the other. Alternatively, the inner cross section of the tubular housing 119 could take on a variety of shapes, such as a polygon, which correspond to a complementary cross sectional shape of the shaft portions 115,117 to effectively transfer rotation and torque along the universal section 116.

Figure 8:
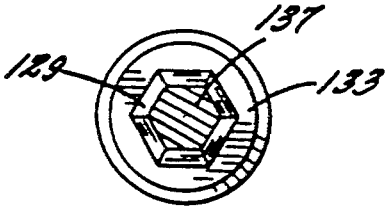
FIG. 8 is a sectional view of a driving head taken along line 8—8 in FIG. 7.

Two drive head portions 129,131, one being secured to an end of each shaft portion 115,117, have a polygonal cross section. As shown in FIG. 8, the cross section takes the form of an equilateral hexagon. Each side of each polygon is curved along the longitudinal axis of rotation of the universal section 116. The drive head portions 129,131 fit into polygonally shaped sockets 133,135, thus forming the universal joints 118,120. The lower polygonally shaped socket 133 is rotationally driven by the drive motor 32. Thus, the drive head portion 129 is rotated by the driven socket 133. The rotational energy is transmitted through the housing 119 to the other drive head portion 131. The polygonally shaped socket 135 accepts this drive head portion 131, and, therefore drives the first pulley 72 which is connected to the socket 135.

The curvature of the polygonal sides of each drive head portion 129,131 allows the drive head portions 129,131 to be offset at an angle while remaining in driving engagement with the respective sockets 133,135. The curvature may be either spherical or ellipsoidal, with the center of curvature lying on the longitudinal axis of the shaft or spaced therefrom. The curvature of the polygonal sides and the radius of curvature of the neck portion 137 dictate the range of motion that the shaft is capable of achieving.

To enable the mechanism 10 to stack coins of different diameters, a width adjustor 44 varies the width of the coin transporting channel 24. Preferably the first pair of pulleys 16 is mounted on a first portion 150 of the frame 70, and the second pair of pulleys 18 is mounted on a second portion 152 of the frame 70. The first and second portions 150,152 are slidably mounted on two guide rails 154,156. Each of the portions 150,152 includes a respective rack 168,170 mounted thereon, which is positioned parallel to the guide rails 154,156. A width control dial 158 includes a toothed pulley 160 mounted thereon. A belt 162 interconnects the toothed pulley 160 to another toothed pulley 164 which carries a rack gear 166. The rack gear 166 is mounted between the guide rail 154,156, and meshes with the two racks 168,170, one on each side. Rotation of the width control dial 158 causes rotation of the rack gear 166. The rack gear 166 drives the racks 168,170, and thus the first and second portions 150,152, in opposite directions along the guide rails 154,156. Rotation of the width control dial 158 in a first direction moves the first and second portions 150,152 closer together, while rotation in the opposite direction moves the first and second portions 150,152 apart.

Figure 9:
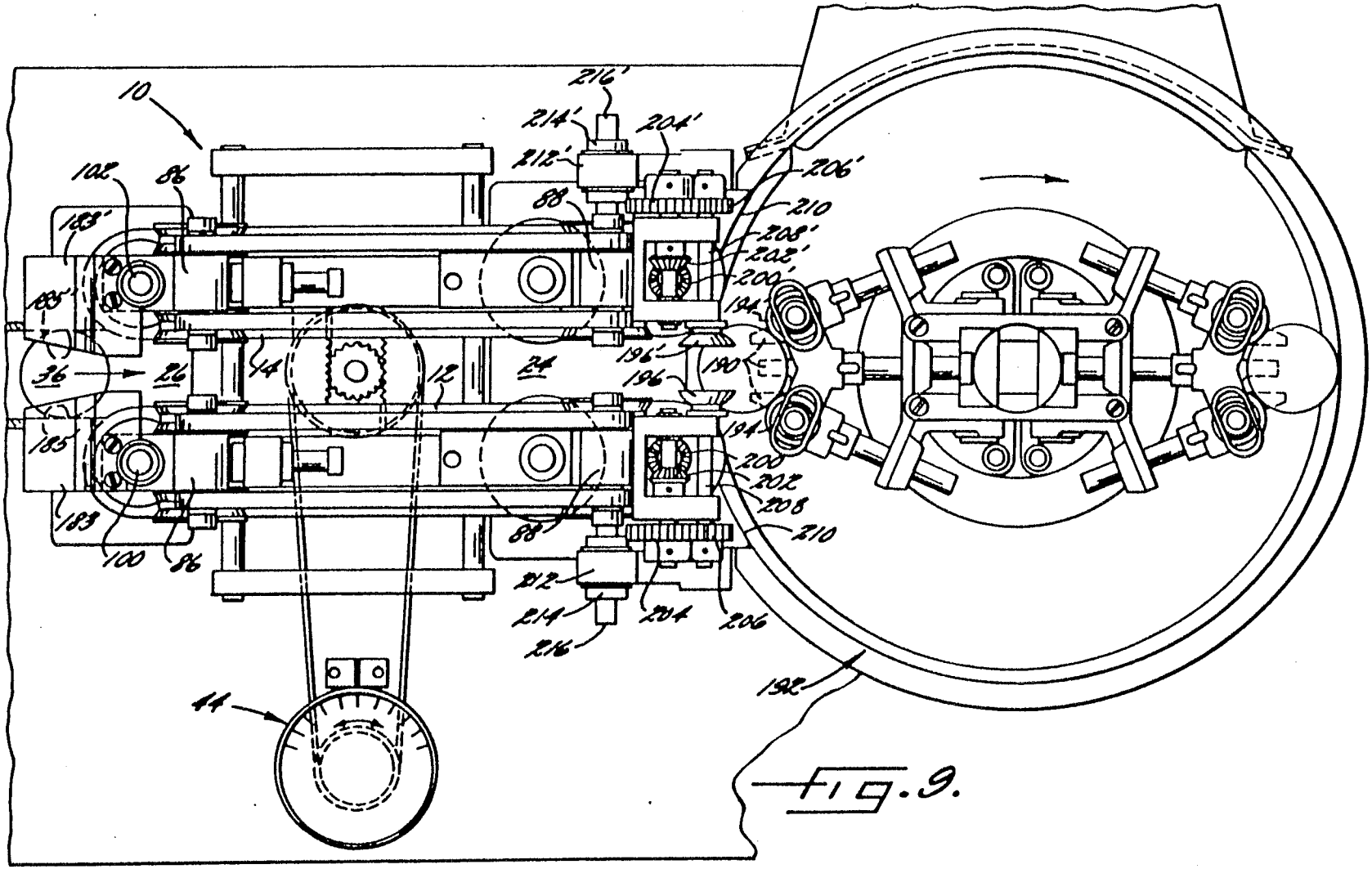
FIG. 9 is a top plan view of a preferred embodiment of a coin transporting, stacking, and wrapping mechanism embodying the present invention; an FIG. 10 is a side plan view of a preferred embodiment of a coin transporting, stacking, and wrapping mechanism embodying the present invention.
Figure 10:
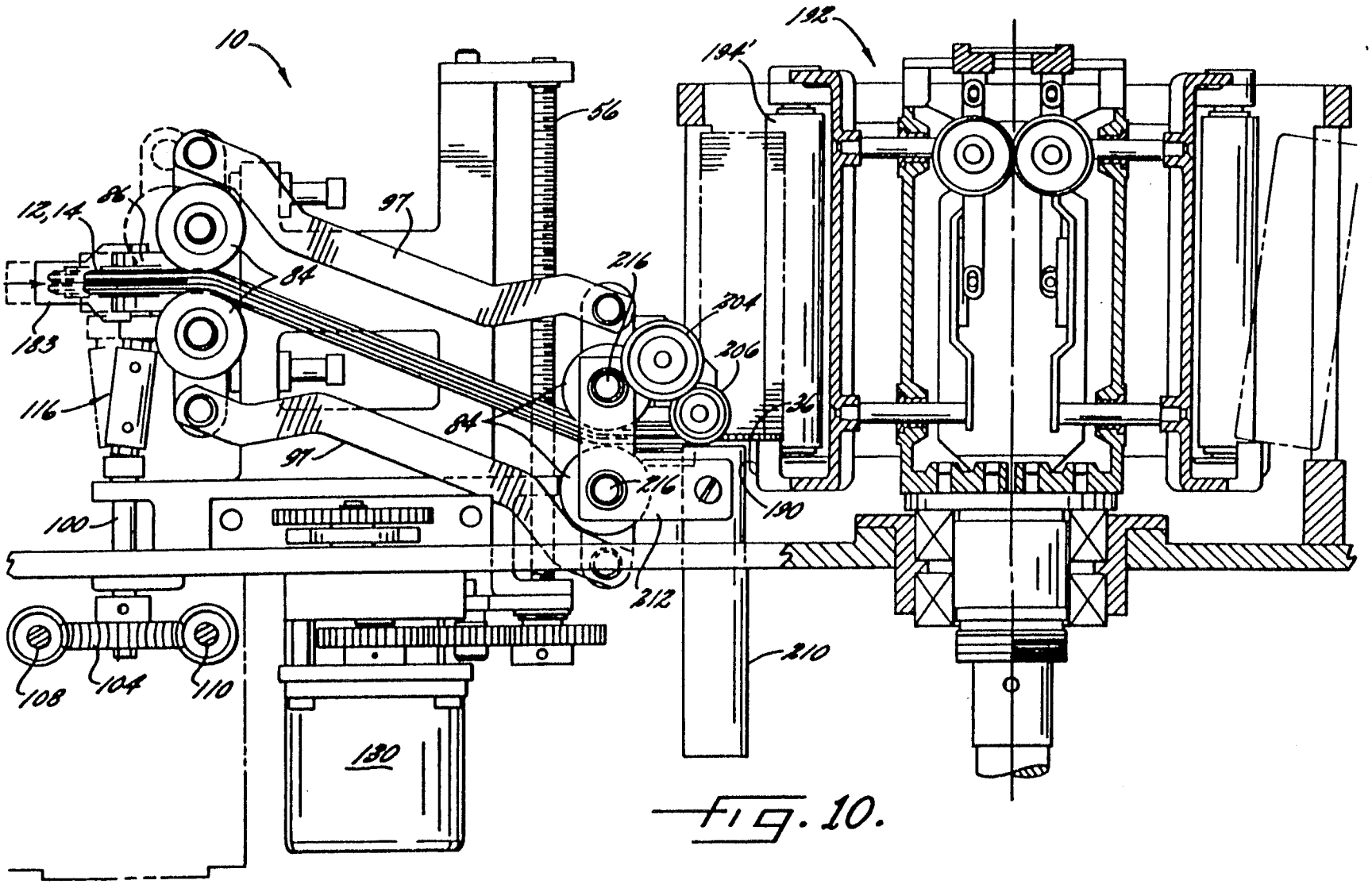

FIGS. 9 and 10 illustrate the coin transporting and stacking mechanism 10 within a coin handling system 172. A coin separating disc 180 uses centrifugal force generated by the rotation of the disc 180 to drive coins one by one through a passageway 181. A coin feeder 182 receives the coins onto two parallel guide rails 186. Preferably, one of the guide rails is moveable to adjust the distance between the two guide rails 186 according to the diameter of the coins to be stacked, so that coins having a diameter smaller than the selected diameter fall through the rails 186 and into a coin chute or similar device (not shown). A belt 184 on the coin feeder 182 transports the coins 36 at a first preselected speed, along the pair of guide rails 186, toward the coin receiving end 26 of the coin transporting channel 24. At the intersection of the coin feeder 182 and the coin receiving end 26, a pair of guide pieces 183,183' provide a smooth transition for the coins. The guide pieces 183,183' are mounted on the first support 86 so that they guide coins within guide slots 185,185' directly into the slots 38 in the belts 12,14.

Preferably, the belts 12,14 which form the coin transporting channel 24 are rotating at a second preselected speed which is greater than the first preselected speed. The speed differential provides spaces between each pair of coins in the coin transporting channel 24, since a finite amount of time is needed to raise the coin ejecting end 28 after a sensed coin ejection. A pulley speed of about 300 rpm, which translates to a channel speed of about 18 inches/sec., transports approximately 2000 coins/minute, thus producing about 30 stacks/minute. In this particular embodiment, a sensor 143 on the coin separating disc 180 delivers a signal in response to each fed coin to the signal processor 144. The signal processor 144 uses this signal to count the number of coins being fed onto a stack.

As a coin enters the coin receiving end 26 of the coin transporting channel 24, the endless belts 12,14 converge on the coin. If slotted belts are used, as shown in FIG. 3, the coin becomes wedged into the slots of the belts 12,14 and is carried along the coin transporting channel 24. If V-slotted belts are used, the belts hold the coin between them, and transport the coin along the coin transporting channel 24. Initially, the coin receiving end 26 is higher than the coin ejecting end 28, so the coins are transported down a ramp formed by the downward slope of the coin transporting channel 24. The coins are ejected when the belts 12,14 diverge at the coin ejecting end 28 of the coin transporting channel 24. The coins are preferably ejected onto a stacking plate 190 of a coin wrapping mechanism 192.

When ejected, the coins have a tendency to bounce off of the wrapping rollers 194,194' of the coin wrapping mechanism 192. To retard the bouncing action, a pair of rotating, resilient discs 196,198 apply pressure and driving force to the coins ejected onto the top of the coin stack. The discs 196,198 are positioned so that their peripheral edges intersect the coins transporting channel 24. These edges urge the coins downwardly onto the top of the stack, and toward the wrapping rollers 194,194'. As a coin bounces off of the wrapping rollers 194,194', the resilient discs 196,198 force the coin back against the rollers. To drive the resilient discs 196,198, miter gears 200,200' attached to the shaft of each of the second pulleys 76,78 mesh with miter gears 202,202' mounted on the second support 88. The miter gears 202,202' turn spur gears 204,204'. The spur gears 204,204' mesh with other spur gears 206,206' which are connected via shafts 208,208' to the resilient discs 196,198. Preferably, the gear ratios are selected so that the peripheral edges of the discs 196,198 are moving at the same speed as the belts 12,14.

Each time a coin is ejected, a sensor 142 delivers a signal to the signal processor 144. Since the disc sensor 143 is used to count the number of coins, the ejected coin sensor 142 merely tells the signal processor 144 to rotate the stepper motor by a first predetermined amount. The stepper motor 130 raises the coin ejecting end 28 by an amount substantially equal to or slightly greater than the thickness of the coin to assure proper stacking. As the coin ejecting end 28 raises or lowers, a wall 210 raises or lowers to prevent coins from falling out of the wrapping mechanism 192. The wall 210 is connected to the second support 88 by L-shaped brackets 212,212'. The brackets 212,212' have linear bearings 214,214' that slide on rods 216,216' which are mounted onto the second support 88 as the width of the coin transporting channel 24 changes.

Upon completion of a full stack, the coin wrapping mechanism 192 is signaled by the signal processor 144 to wrap the stack and index 180 to accept another stack. Once the coin wrapping mechanism 192 indexes, the coin ejecting end 28 lowers to its starting position to begin another stack. Should it be necessary to prevent coins from being ejected in the interim between the completion of a stack and repositioning of the coin ejecting end 28, the coin separator and/or the belts may be stopped for a short time. A detailed description of the operation of the coin wrapping mechanism 192 is found in U.S. Pat. No. 4,674,260 issued Jun. 23, 1987 to Rasmussen et al. The detailed operation of the wrapping mechanism 192 is not necessary for the understanding of the present invention, and will not be repeated herein.

I claim:

1. An apparatus for transporting coins, comprising:

first and second endless belts mounted on respective pairs of pulleys, each of said belts having a coin engaging portion, said coin engaging portions being substantially parallel to one another and forming a coin transporting channel therebetween having a coin receiving end and a coin ejecting end, said belts having an outwardly facing slot therein adapted to grip diametrically opposed edges of a coin in the coin transporting channel, said slots forming a flexible pair of legs having a coin receiving portion and a coin retaining portion, whereby a coin entering said slots pushes between the receiving portions of said legs to force said legs apart, and is held by the coin retaining portions of said legs; and means for counter-rotating said endless belts, whereby said belts converge on a coin to be transported at the coin receiving end of the coin transporting channel, grip the diametrically opposed edges of the coin, transport the coin between said belts from the coin receiving end to the coin ejecting end of the coin transporting channel, and eject the coin at the coin ejecting end of the coin transporting channel.

2. The apparatus as set forth in claim 1, further comprising:

means for controllably varying the width of said coin transporting channel.

3. The apparatus as set forth in claim 2 wherein, said width varying means controllably varies the width of the coin transporting channel form a first width for transporting coins of a first preselected diameter to a second width for transporting coins of a second preselected diameter.

4. An apparatus for transporting coins, comprising:

a frame;

a first pair of spaced apart pulleys being rotatably mounted on said frame, and having substantially vertical axes of rotation;

a second pair of spaced apart pulleys being rotatably mounted on said frame, and having substantially vertical axes of rotation, said second pair of pulleys being aligned with and horizontally spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end, said belts having an outwardly facing slot therein adapted to grip diametrically opposed edges of a coin in the transporting channel, said slots forming a flexible pair of legs having a coin receiving portion and a coin retaining portion, whereby a coin entering said slots pushes between the receiving portions of said legs to force said legs apart, and is held by the coin retaining portions of said legs; and means for counter-rotating said endless belts, whereby said belts converge on a coin to be transported at the coin receiving end of the coin transporting channel, grip the diametrically opposed edges of the coin, transport the coin between said belts from the coin receiving end to the coin ejecting end of the coin transporting channel, and eject the coin at the coin ejecting end of the coin transporting channel.

5. The apparatus as set forth in claim 4, further comprising:

means for controllably varying the width of said coin transporting channel.

6. The apparatus as set forth in claim 5 wherein, said width varying means controllably varies the width of the coin transporting channel from a first width for transporting coins of a first preselected diameter to a second width for transporting coins of a second preselected diameter.

7. The apparatus as set forth in claim 4 wherein, each of said pairs of pulleys include a first and second pulley, said respective first pulleys being aligned to rotate in a first substantially horizontal plane, and said respective second pulleys being aligned to rotate in a second substantially horizontal plane.

8. An apparatus for transporting coins, comprising:

a frame;

a first pair of spaced apart pulleys being rotatably mounted on said frame, and having substantially vertical axes of rotation, said axes defining a first vertical plane;

a second pair of spaced apart pulleys being rotatably mounted on said frame, and having substantially vertical axes of rotation, said axes defining a second vertical plane which is parallel to said first vertical plane and spaced therefrom;

each of said pairs of pulleys include a first and second pulley, said respective first pulleys being aligned and adapted to rotate in a first substantially horizontal plane, and said respective second pulleys being aligned and adapted to rotate in a second substantially horizontal plane, said second substantially horizontal plane being distinct from said first substantially horizontal plane;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end and having a width responsive to the diameter of a coin to be transported, said belts having an outwardly facing slot therein adapted to grip diametrically opposed edges of a coin in the coin transporting channel;

means for controllably varying the width of said coin transporting channel; and means for counter-rotating said endless belts, whereby said belts converge on a coin to be transported at the coin receiving end of the coin transporting channel, grip the diametrically opposed edges of the coin, transport the coin between said belts from the coin receiving end to the coin ejecting end of the con transporting channel, and eject the coin at the coin ejecting end of the coin transporting channel.

9. The apparatus, as set forth in claim 8, further comprising:

means for guiding said belts onto the respective pulleys.

10. The apparatus, as set forth in claim 9, wherein said guiding means comprises:

at least one roller being rotatably mounted adjacent each of said pulleys and being adapted to maintain contact of said respective endless belt with said respective pulley.

11. An apparatus for transporting and stacking coins, comprising:

first and second endless belts mounted on respective pairs of pulleys, each of said belts having a coin engaging portion, said coin engaging portions being substantially parallel to one another and forming a coin transporting channel therebetween having a coin receiving end and a coin ejecting end;

means for counter-rotating said endless belts, whereby said belts receive a coin at the coin receiving end of the coin transporting channel, transport the coin between said belts from the coin receiving end to the coin ejecting end of the coin transporting channel, and eject the coin at the coin ejecting end of the coin transporting channel; and means for moving the coin ejecting end of the coin transporting channel in a direction substantially perpendicular to said parallel coin engaging portions of said belts which form the coin ejecting end of the coin transporting channel.

12. The apparatus, as set forth in claim 11, wherein said moving means comprises:

means for raising the coin ejecting end of the coin transporting channel by a first predetermined distance in response to a first predetermined number of coins being ejected from the coin ejecting end; and means for lowering the coin ejecting end of the coin transporting channel by a second predetermined distance in response to a second predetermined number of coins being ejected from the coin ejecting end.

13. The apparatus, as set forth in claim 11, wherein said moving means comprises:

means for sensing a coin being ejected from the coin ejecting end of the coin transporting channel, and delivering a signal in response thereto;

means for raising the coin ejecting end of the coin transporting channel by a first predetermined distance in response to receiving a first predetermined number of delivered signals; and means for lowering the coin ejecting end of the coin transporting channel by a second predetermined distance in response to receiving a second predetermined number of delivered signals.

14. The apparatus, as set forth in claim 11, wherein said moving means comprises:

means for raising the coin ejecting end of the coin transporting channel at a first continuous rate to stack consecutively ejected coins one on top of the other; and means for lowering the coin ejecting end of the coin transporting channel at a second continuous rate in response to completion of the stack of coins.

15. An apparatus for transporting and stacking coins, comprising:

first and second endless belts mounted on respective pairs of pulleys, each of said belts having a coin engaging portion, said coin engaging portions being substantially parallel to one another and forming a coin transporting channel therebetween having a coin receiving end and a coin ejecting end;

means for counter-rotating said endless belts, whereby said belts receive a coin at the coin receiving end of the coin transporting channel, transport the coin between said belts from the coin receiving end to the coin ejecting end of the coin transporting channel, and eject the coin at the coin ejecting end of the coin transporting channel; and means for moving the coin ejecting end of the coin transporting channel in a direction substantially perpendicular to said parallel coin engaging portions of said belts which form the coin ejecting end of the coin transporting channel, said coin transporting channel having a width responsive to the diameter of a coin to be transported, whereby diametrically opposed edges of the coin are engaged by said coin engaging portions of said belts when the coin is in the coin transporting channel.

16. The apparatus as set forth in claim 15, further comprising:

means for controllably varying the width of said coin transporting channel.

17. The apparatus as set forth in claim 16 wherein, said width varying means controllably varies the width of the coin transporting channel from a first width for transporting coins of a first preselected diameter to a second width for transporting coins of a second preselected diameter.

18. An apparatus for transporting and stacking coins, comprising:

first and second endless belts mounted on respective pairs of pulleys, each of said belts having a coin engaging portion, said coin engaging portions being substantially parallel to one another and forming a coin transporting channel therebetween having a coin receiving end and a coin ejecting end, said belts having an outwardly facing slot therein adapted to grip diametrically opposed edges of a coin in the coin transporting channel;

means for counter-rotating said endless belts, whereby said belts converge on a coin to be transported at the coin receiving end of the coin transporting channel, grip the diametrically opposed edges of the coin, transport the coin between said belts from the coin receiving end to the coin ejecting end of the coin transporting channel, and eject the coin at the coin ejecting end of the coin transporting channel; and means for moving the coin ejecting end of the coin transporting channel in a direction substantially perpendicular to said parallel coin engaging portions of said belts which form the coin ejecting end of the coin transporting channel.

19. The apparatus as set forth in claim 18, further comprising:

means for controllably varying the width of said coin transporting channel.

20. The apparatus as set forth in claim 19 wherein, said width varying means controllably varies the width of the coin transporting channel from a first width for transporting coins of a first preselected diameter to a second width for transporting coins of a second preselected diameter.

21. An apparatus for transporting and stacking coins, comprising:

first and second endless belts mounted on respective pairs of pulleys, each of said belts having a coin engaging portion, said coin engaging portions being substantially parallel to one another and forming a coin transporting channel therebetween having a coin receiving end and a coin ejecting end;

means for counter-rotating said endless belts, whereby said belts receive a coin at the coin receiving end of the coin transporting channel, transport the coin between said belts from the coin receiving end to the coin ejecting end of the coin transporting channel, and eject the coin at the coin ejecting end of the coin transporting channel; and means for moving the coin ejecting end of the coin transporting channel in a direction substantially perpendicular to said parallel coin engaging portions of said belts which form the coin ejecting end of the coin transporting channel in response to a predetermined number of coins being ejected from the coin ejecting end of the coin transporting channel.

22. An apparatus for transporting and stacking coins, comprising:

first and second endless belts mounted on respective pairs of pulleys, each of said belts having a coin engaging portion, said coin engaging portions being substantially parallel to one another and forming a coin transporting channel therebetween having a coin receiving end and a coin ejecting end, said belts having an outwardly facing slot therein adapted to grip diametrically opposed edges of a coin in the coin transporting channel;

means for counter-rotating said endless belts, whereby said belts receive a coin at the coin receiving end of the con transporting channel, transport the coin between said belts from the coin receiving end to the coin ejecting end of the coin transporting channel, and eject the coin at the coin ejecting end of the coin transporting channel; and means for moving the coin ejecting end of the coin transporting channel in a direction substantially perpendicular to said parallel coin engaging portions of said belts which form the coin ejecting end of the coin transporting channel in response to a predetermined number of coins being ejected from the coin ejecting end of the coin transporting channel.

23. An apparatus for transporting and stacking coins, comprising:

first and second endless belts mounted on respective pairs of pulleys, each of said belts having a coin engaging portion, said coin engaging portions being substantially parallel to one another and forming a coin transporting channel therebetween having a coin receiving end and a coin ejecting end;

means for counter-rotating said endless belts, whereby said belts receive a coin at the coin receiving end of the coin transporting channel, transport the coin between said belts from the coin receiving end to the coin ejecting end of the coin transporting channel, and eject the coin at the coin ejecting end of the coin transporting channel;

means for moving the coin ejecting end of the coin transporting channel in a direction substantially perpendicular to said parallel coin engaging portions of said belts which form the coin ejecting end of the coin transporting channel; and means for allowing movement of the coin receiving end of the coin transporting channel in response to the movement of the coin ejecting end of the coin transporting channel.

24. The apparatus, as set forth in claim 23, wherein said counter-rotating means comprises:

a motor having an output shaft and being adapted to controllably rotate said output shaft;

a drive shaft being operably connected between said output shaft and a selected pulley.

25. The apparatus as set forth in claim 23 wherein, said coin transporting channel has a width responsive to the diameter of a coin to be transported, whereby diametrically opposed edges of the coin are engaged by said coin engaging portions of said belts when the coin is in the coin transporting channel.

26. The apparatus as set forth in claim 25, further comprising:

means for controllably varying the width of said coin transporting channel.

27. The apparatus as set forth in claim 26 wherein, said width varying means controllably varies the width of the coin transporting channel from a first width for transporting coins of a first preselected diameter to a second width for transporting coins of a second preselected diameter.

28. An apparatus for transporting and stacking coins, comprising:

first and second endless belts mounted on respective pairs of pulleys, each of said belts having a coin engaging portion, said coin engaging portions being substantially parallel to one another and forming a coin transporting channel therebetween having a coin receiving end and a coin ejecting end, said belts having an outwardly facing slot therein adapted to grip diametrically opposed edges of a coin in the coin transporting channel;

means for counter-rotating said endless belts, whereby said belts receive a coin at the coin receiving end of the coin transporting channel, transport the coin between said belts from the coin receiving end to the coin ejecting end of the coin transporting channel, and eject the coin at the coin ejecting end of the coin transporting channel;

means for moving the coin ejecting end of the coin transporting channel in a direction substantially perpendicular to said parallel coin engaging portions of said belts which form the coin ejecting end of the coin transporting channel; and means for allowing movement of the coin receiving end of the coin transporting channel in response to the movement of the coin ejecting end of the coin transporting channel.

29. An apparatus for transporting and stacking coins, comprising:

first and second endless belts mounted on respective pairs of pulleys, each of said belts having a coin engaging portion, said coin engaging portions being substantially parallel to one another and forming a coin transporting channel therebetween having a coin receiving end and a coin ejecting end;

means for counter-rotating said endless belts, whereby said belts receive a coin at the coin receiving end of the coin transporting channel, transport the coin between said belts from the coin receiving end to the coin ejecting end of the coin transporting channel, and eject the coin at the coin ejecting end of the coin transporting channel;

means for sensing a coin being ejected from the coin ejecting end of said coin transporting channel, and delivering a signal in response thereto; and means for moving the coin ejecting end of the coin transporting channel in a direction substantially perpendicular to said parallel coin engaging portions of said belts which form the coin ejecting end of the coin transporting channel in response to said delivered signal.

30. An apparatus for transporting and stacking coins, comprising:

first and second endless belts mounted on respective pairs of pulleys, each of said belts having a coin engaging portion, said coin engaging portions being substantially parallel to one another and forming a coin transporting channel therebetween having a coin receiving end and a coin ejecting end;

said belts having an outwardly facing slot therein adapted to grip diametrically opposed edges of a coin in the coin transporting channel;

means for counter-rotating said endless belts, whereby said belts receive a coin at the coin receiving end of the coin transporting channel, transport the coin between said belts from the coin receiving end to the coin ejecting end of the coin transporting channel, and eject the coin at the coin ejecting end of the coin transporting channel;

means for sensing a coin being ejected from the coin ejecting end of said coin transporting channel, and delivering a signal in response thereto; and means for moving the coin ejecting end of the coin transporting channel in a direction substantially perpendicular to said parallel coin engaging portions of said belts which form the coin ejecting end of the coin transporting channel in response to said delivered signal.

31. An apparatus for transporting and stacking coins, comprising:

a frame;

a first pair of spaced apart pulleys being rotatably mounted on said frame, and having axes of rotation which are substantially parallel with one another;

a second pair of spaced apart pulleys being rotatably mounted on said frame, and having axes of rotation which are substantially parallel with one another, said second pair of pulleys being spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end;

means for counter-rotating said endless belts, whereby said belts receive a coin at the coin receiving end of the coin transporting channel, transport the coin between said belts from the coin receiving end to the coin ejecting end of the coin transporting channel, and eject the coin at the coin ejecting end of the coin transporting channel;

means for moving the coin ejecting end of the coin transporting channel in a direction substantially perpendicular to said parallel coin engaging portions of said belts which form the coin ejecting end of the coin transporting channel; and means for allowing movement of the coin receiving end of the coin transporting channel in a direction along the coin transporting channel in response to the movement of the coin ejecting end of the coin transporting channel.

32. The apparatus as set forth in claim 31 wherein, said coin transporting channel has a width responsive to the diameter of a coin to be transported, whereby diametrically opposed edges of the coin are engaged by said coin engaging portions of said belts when the coin is in the coin transporting channel.

33. The apparatus as set forth in claim 32, further comprising:

means for controllably varying the width of said coin transporting channel

34. The apparatus as set forth in claim 33 wherein, said width varying means controllably varies the width of the coin transporting channel from a first width for transporting coins of a first preselected diameter to a second width for transporting coins of a second preselected diameter.

35. The apparatus as set forth in claim 31 wherein, the axes of rotation of said first pair of pulleys are substantially parallel to the axes of rotation of said second pair of pulleys.

36. The apparatus as set forth in claim 35 wherein, each of said pairs of pulleys include a first and second pulley, said respective first pulleys being aligned to rotate in a first plane, and said respective second pulleys being aligned to rotate in a second plane which is substantially parallel to said first plane.

37. An apparatus for transporting and stacking coins, comprising:

a frame;

a first pair of space apart pulleys being rotatably mounted on said frame, and having axes of rotation which are substantially parallel with one another;

a second pair of spaced apart pulleys being rotatably mounted on said frame, and having axes of rotation which are substantially parallel with one another, said second pair of pulleys being spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end, said belts having an outwardly facing slot therein adapted to grip diametrically opposed edges of a coin in the coin transporting channel;

means for counter-rotating said endless belts, whereby said belts receive a coin at the coin receiving end of the coin transporting channel, transport the coin between said belts from the coin receiving end to the coin ejecting end of the coin transporting channel, and eject the coin at the coin ejecting end of the coin transporting channel;

means for moving the coin ejecting end of the coin transporting channel in a direction substantially perpendicular to said parallel coin engaging portions of said belts which form the coin ejecting end of the coin transporting channel; and means for allowing movement of the coin receiving end of the coin transporting channel in a direction along the coin transporting channel in response to the movement of the coin ejecting end of the coin transporting channel.

38. An apparatus for transporting and stacking coins, comprising:

a frame;

a first pair of spaced apart pulleys being rotatably mounted on said frame, and having substantially vertical axes of rotation;

a second pair of spaced apart pulleys being rotatably mounted on sad frame, and having substantially vertical axes of rotation, said second pair of pulleys being aligned with and horizontally spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end;

means for counter-rotating said endless belts, whereby said belts transport a coin between said belts from the coin receiving end to the coin ejecting end of the coin transporting channel; and means for vertically moving the coin ejecting end of the coin transporting channel.

39. The apparatus as set forth in claim 38 wherein, each of said pairs of pulleys include a first and second pulley, said respective first pulleys being aligned to rotate in a first substantially horizontal plane, and said respective second pulleys being aligned to rotate in a second substantially horizontal plane.

40. An apparatus for transporting and stacking coins, comprising:

a frame;

a first pair of spaced apart pulleys being rotatably mounted on said frame, and having substantially vertical axes of rotation;

a second pair of space apart pulleys being rotatably mounted on said frame, and having substantially vertical axes of rotation, said second pair of pulleys being aligned with and horizontally spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end;

means for counter-rotating said endless belts, whereby said belts transport a coin between said belts from the coin receiving end to the coin ejecting end of the coin transporting channel, said coin transporting channel having a width responsive to the diameter of a coin to be transported, whereby diametrically opposed edges of the coin are engaged by said coin engaging portions of said belts when the coin is in the coin transporting channel; and means for vertically moving the coin ejecting end of the coin transporting channel.

41. The apparatus as set forth in claim 40, further comprising:

means for controllably varying the width of said coin transporting channel.

42. The apparatus as set forth in claim 41 wherein, said width varying means controllably varies the width of the coin transporting channel from a first width for transporting coins of a first preselected diameter to a second width for transporting coins of a second preselected diameter.

43. An apparatus for transporting and stacking coins, comprising:

a frame;

a first pair of spaced apart pulleys being rotatably mounted on said frame, and having substantially vertical axes of rotation;

a second pair of spaced apart pulleys being rotatably mounted on said frame, and having substantially vertical axes of rotation, said second pair of pulleys being aligned with and horizontally spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end, said belts having an outwardly facing slot therein adapted to grip diametrically opposed edges of a coin in the coin transporting channel;

means for counter-rotating said endless belts, whereby said belts transport a coin between said belts from the coin receiving end to the coin ejecting end of the coin transporting channel; and means for vertically moving the coin ejecting end of the coin transporting channel.

44. An apparatus for transporting and stacking coins, comprising:

a frame;

a first pair of spaced apart pulleys being rotatably mounted on said frame, and having substantially vertical axes of rotation;

a second pair of spaced apart pulleys being rotatably mounted on said frame, and having substantially vertical axes of rotation, said second pair of pulleys being aligned with and horizontally spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end;

means for counter-rotating said endless belts, whereby said belts transport a coin between said belts from the coin receiving end to the coin ejecting end of the coin transporting channel; and mean for vertically moving the coin ejecting end of the coin transporting channel in response to a predetermined number of coins being ejected from the coin ejecting end of the coin transporting channel.

45. An apparatus for transporting and stacking coins, comprising:

a frame;

a first pair of spaced apart pulleys being rotatably mounted on said frame, and having substantially vertical axes of rotation;

a second pair of spaced apart pulleys being rotatably mounted on said frame, and having substantially vertical axes of rotation, said second pair of pulleys being aligned with and horizontally spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end, said belts having an outwardly facing slot therein adapted to grip diametrically opposed edges of a coin in the coin transporting channel;

means for counter-rotating said endless belts, whereby said belts transport a coin between said belts from the coin receiving end to the coin ejecting end of the coin transporting channel; an means for vertically moving the coin ejecting end of the coin transporting channel in response to a predetermined number of coins being ejected from the coin ejecting end of the coin transporting channel.

46. An apparatus for transporting and stacking coins, comprising:

a frame;

a first pair of spaced apart pulleys being rotatably mounted on said frame, and having substantially vertical axes of rotation;

a second pair of spaced apart pulleys being rotatably mounted on said frame, and having substantially vertical axes of rotation, said second pair of pulleys being aligned with and horizontally spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end;

means for counter-rotating said endless belts, whereby said belts transport a coin between said belts from the coin receiving end to the coin ejecting end of the coin transporting channel means for sensing a coin being ejected from the coin ejecting end of the coin transporting channel, and delivering a signal in response thereto; and means for vertically moving the coin ejecting end of the coin transporting channel in response to said delivered signal.

47. An apparatus for transporting and stacking coins, comprising:

a frame;

a first pair of spaced apart pulleys being rotatably mounted on said frame, and having substantially vertical axes of rotation;

a second pair of spaced apart pulleys being rotatably mounted on said frame, and having substantially vertical axes of rotation, said second pair of pulleys being aligned with and horizontally spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end, said belts having an outwardly facing slot therein adapted to grip diametrically opposed edges of a coin in the coin transporting channel;

means for counter-rotating said endless belts, whereby said belts transport a coin between said belts from the coin receiving end to the coin ejecting end of the coin transporting channel;

means for sensing a coin being ejected from the coin ejecting end of the coin transporting channel, and delivering a signal in response thereto; and means for vertically moving the coin ejecting end of the coin transporting channel in response to said delivered signal.

48. An apparatus for transporting and stacking coins, comprising:

a frame;

a first pair of spaced apart pulleys being rotatably mounted on said frame, and having substantially vertical axes of rotation;

a second pair of spaced apart pulleys being rotatably mounted on said frame, and having substantially vertical axes of rotation, said second pair of pulleys being aligned with and horizontally spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end;

means for counter-rotating said endless belts, whereby said belts receive a coin at the coin receiving end of the coin transporting channel, transport the coin between said belts from the coin receiving end to the coin ejecting end of the coin transporting channel, and eject the coin at the coin ejecting end of the coin transporting channel;

means for vertically moving the coin ejecting end of the coin transporting channel; and means for allowing horizontal movement of the coin receiving end of the coin transporting channel in response to vertical movement of the coin ejecting end of the coin transporting channel.

49. The apparatus as set forth in claim 48 wherein, each of said pairs of pulleys include a first and second pulley, said respective first pulleys being aligned to rotate in a first substantially horizontal plane, and said respective second pulleys being aligned to rotate in a second substantially horizontal plane.

50. An apparatus for transporting and stacking coins, comprising:

a frame;

a first pair of spaced apart pulleys being rotatably mounted on said frame, and having substantially vertical axes of rotation;

a second pair of spaced apart pulleys being rotatably mounted on said frame, and having substantially vertical axes of rotation, said second pair of pulleys being aligned with and horizontally spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end;

means for counter-rotating said endless belts, whereby said belts receive a coin at the coin receiving end of the coin transporting channel, transport the coin between said belts form the coin receiving end to the coin ejecting end of the coin transporting channel, and eject the coin at the coin ejecting end of the coin transporting channel, said coin transporting channel having a width responsive to the diameter of a coin to be transported, whereby diametrically opposed edges of the coin are engaged by said coin engaging portions of said belts when the coin is in the coin transporting channel;

means for vertically moving the coin ejecting end of the coin transporting channel; and means for allowing horizontal movement of the coin receiving end of the coin transporting channel in response to vertical movement of the coin ejecting end of the coin transporting channel.

51. The apparatus as set forth in claim 50, further comprising:

means for controllably varying the width of said coin transporting channel.

52. The apparatus as set forth in claim 51 wherein, said width varying means controllably varies the width of the coin transporting channel from a first width for transporting coins of a first preselected diameter to a second width for transporting coins of a second preselected diameter.

53. An apparatus for transporting and stacking coins, comprising:

a frame;

a first pair of spaced apart pulleys being rotatably mounted on said frame, and having substantially vertical axes of rotation;

a second pair of spaced apart pulleys being rotatably mounted on said frame, and having substantially vertical axes of rotation, said second pair of pulleys being aligned with and horizontally spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end, said belts having an outwardly facing slot therein adapted to grip diametrically opposed edges of a coin in the coin transporting channel;

means for counter-rotating said endless belts, whereby said belts converge on a coin to be transported at the coin receiving end of the coin transporting channel, grip the diametrically opposed edges of the coin, transport the coin between said belts from the coin receiving end to the coin ejecting end of the coin transporting channel, and eject the coin at the coin ejecting end of the coin transporting channel;

means for vertically moving the coin ejecting end of the coin transporting channel; and means for allowing horizontal movement of the coin receiving end of the coin transporting channel in response to vertical movement of the coin ejecting end of the coin transporting channel.

54. The apparatus as set forth in claim 53, further comprising:

means for controllably varying the width of said coin transporting channel.

55. The apparatus as set forth in claim 54 wherein, said width varying means controllably varies the width of the coin transporting channel from a first width for transporting coins of a first preselected diameter to a second width for transporting coins of a second preselected diameter.

56. The apparatus as set forth in claim 53 wherein, each of said pairs of pulleys include a first and second pulley, said respective first pulleys being aligned to rotate in a first substantially horizontal plane, and said respective second pulleys being aligned to rotate in a second substantially horizontal plane.

57. An apparatus for transporting and stacking coins, comprising:

a frame;

a first pair of spaced apart pulleys being rotatably mounted on said frame, and having substantially vertical axes of rotation;

a second pair of spaced apart pulleys being rotatably mounted on said frame, and having substantially vertical axes of rotation, said second pair of pulleys being aligned with and horizontally spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end;

means for counter-rotating said endless belts, whereby said belts transport a coin between said belts from the coin receiving end to the coin ejecting end of the coin transporting channel;

means for sensing a coin being ejected from the coin ejecting end of the coin transporting channel, and delivering a signal in response thereto; and means for raising the coin ejecting end of the coin transporting channel by a predetermined amount in response to said delivered signal.

58. An apparatus for transporting and stacking coins, comprising:

a frame;

a first pair of spaced apart pulleys being rotatably mounted on said frame, and having substantially vertical axes of rotation, said axes defining a first vertical plane;

a second pair of spaced apart pulleys being rotatably mounted on said frame, and having substantially vertical axes of rotation, said axes defining a second vertical plane which is parallel to said first vertical plane and spaced therefrom;

each of said pairs of pulleys include a first and second pulley, said respective first pulleys being aligned and adapted to rotate in a first substantially horizontal plane, and said respective second pulleys being aligned and adapted to rotate in a second substantially horizontal plane;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end and having a width responsive to the diameter of a coin to be transported, said belts having an outwardly facing slot therein adapted to grip diametrically opposed edges of a coin in the transporting channel;

means for controllably varying the width of said coin transporting channel;

means for counter-rotating said endless belts, whereby said belts converge on a coin to be transported at the coin receiving end of the coin transporting channel, grip the diametrically opposed edges of the coin, transport the coin between said belts from the coin receiving end to the coin ejecting end of the coin transporting channel, and eject the coin at the coin ejecting end of the coin transporting channel;

means for sensing a coin being ejected from the coin ejecting end of the coin transporting channel, and delivering a signal in response thereto;

means for raising the coin ejecting end of the coin transporting channel by a predetermined amount in response to said delivered signal, thereby stacking consecutively ejected coins on top of one another; and means for allowing horizontal movement of the coin receiving end of the coin transporting channel in response to raising the coin ejecting end of the coin transporting channel.

59. An apparatus for transporting and stacking coins, comprising:

a frame;

a first pair of spaced apart pulleys being rotatably mounted on said frame, and having substantially vertical axes of rotation;

a second pair of spaced apart pulleys being rotatably mounted on said frame, and having substantially vertical axes of rotation, said second pair of pulleys being aligned with and horizontally spaced apart from said first pair of pulleys;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end;

means for counter-rotating said endless belts, whereby said belts transport a coin between said belts from the coin receiving end to the coin ejecting end of the coin transporting channel;

means for sensing a coin being ejected from the coin ejecting end of the coin transporting channel, and delivering a signal in response thereto; and means for lowering the coin ejecting end of the coin transporting channel by a predetermined amount in response to receiving a predetermined number of said delivered signals.

60. An apparatus for transporting and stacking coins, comprising:

a frame;

a first pair of spaced apart pulleys being rotatably mounted on said frame, and having substantially vertical axes of rotation, said axes defining a first vertical plane;

a second pair of spaced apart pulleys being rotatably mounted on said frame, and having substantially vertical axes of rotation, said axes defining a second vertical plane which is parallel to said first vertical plane and spaced therefrom;

each of said pairs of pulleys include a first and second pulley, said respective first pulleys being aligned and adapted to rotate in a first substantially horizontal plane, and said respective second pulleys being aligned and adapted to rotate in a second substantially horizontal plane;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end and having a width responsive to the diameter of a coin to be transported, said belts having an outwardly facing slot therein adapted to grip diametrically opposed edges of a coin in the transporting channel;

means for controllably varying the width of said coin transporting channel;

means for counter-rotating said endless belts, whereby said belts converge on a coin to be transported at the coin receiving end of the coin transporting channel, grip the diametrically opposed edges of the con, transport the coin between said belts form the coin receiving end to the coin ejecting end of the coin transporting channel, and eject the coin at the coin ejecting end of the coin transporting channel;

means for sensing a coin being ejected from the con ejecting end of the coin transporting channel, and delivering a signal in response thereto;

means for lowering the coin ejecting end of the coin transporting channel by a predetermined amount in response to receiving a predetermined number of said delivered signals, thereby positioning the coin ejecting end of the coin transporting channel to begin a stack of coins; and means for allowing horizontal movement of the coin receiving end of the coin transporting channel i response to lowering the coin ejecting end of the coin transporting channel.

61. An apparatus for transporting and stacking coins, comprising:

a frame;

a first pair of spaced apart pulleys being rotatably mounted on said frame, and having substantially vertical axes of rotation, said axes defining a first vertical plane;

a second pair of spaced apart pulleys being rotatably mounted on said frame, and having substantially vertical axes of rotation, said axes defining a second vertical plane which is parallel to said first vertical plane and spaced therefrom;

each of said pairs of pulleys include a first and second pulley, said respective first pulleys being aligned and adapted to rotate in a first substantially horizontal plane, and said respective second pulleys being aligned and adapted to rotate in a second substantially horizontal plane;

first and second endless belts mounted on the first and the second pair of pulleys respectively, each of said belts having a coin engaging portion, said coin engaging portions being substantially parallel to one another and forming a coin transporting channel therebetween having a coin receiving end and a coin ejecting end and having a width responsive to the diameter of a coin to be transported, said belts having an outwardly facing slot therein adapted to grip diametrically opposed edges of a coin in the transporting channel;

means for controllably varying the width of said coin transporting channel;

means for counter-rotating said endless belts, whereby said belts converge on a coin to be transported at the coin receiving end of the coin transporting channel, grip the diametrically opposed edges of the coin, transport the coin between said belts from the coin receiving end to the coin ejecting end of the coin transporting channel, and eject the coin at the coin ejecting end of the coin transporting channel;

means for sensing a coin being ejected from the coin ejecting end of the coin transporting channel, and delivering a signal in response thereto;

means for raising the coin ejecting end of the coin transporting channel by a first predetermined amount in response to said delivered signal, thereby stacking consecutively ejected coins on top of one another; and means for lowering the coin ejecting end of the coin transporting channel by a second predetermined amount in response to receiving a predetermined number of said delivered signals, thereby positioning the coin ejecting end of the coin transporting channel to begin a stack of coins.

62. The apparatus as set forth in claim 61, further comprising means for allowing horizontal movement of the coin receiving end of the coin transporting channel in a first direction in response to movement of the coin ejecting end of the coin transporting channel which decreases the distance between said first and second horizontal planes, and allowing horizontal movement of the coin receiving end of the coin transporting channel in a second direction in response to movement of the coin ejecting end of the coin transporting channel which increases the distance between said first and second horizontal planes.

63. A method of transporting coins, comprising:

counter-rotating a pair of endless belts which converge around a first pair of pulleys to form a coin receiving end of a coin transporting channel and diverge around a second pair of pulleys to form a coin ejecting end of the coin transporting channel;

engaging diametrically opposed edges of consecutive coins between the converging belts at the coin receiving end of the coin transporting channel transporting said coins between the belts along the coin transporting channel;

disengaging the edges of the coins as the belts diverge at the coin ejecting end of the coin transporting channel; and moving the coin ejecting end of the coin transporting channel in a direction to effect stacking of consecutively ejected coins one o .top of the other.

64. A method of transporting coins, comprising:

counter-rotating a pair of endless belts each having a coin engaging portion and a coin gripping slot therein, said coin engaging portions forming a coin transporting channel therebetween;

gripping diametrically opposed edges of coins as the coins consecutively enter the coin transporting channel;

transporting the coins between said belts along the coin transporting channel;

releasing the edges of the coins as the coins consecutively exit the coin transporting channel; and moving the coin transporting channel in a direction to effect stacking of consecutive coins one on top of the other as the coins exit the coin transporting channel.

65. A method of transporting coins, comprising:

counter-rotating a pair of slotted endless belts which converge around a first pair of pulleys to form a coin receiving end of a coin transporting channel and diverge around a second pair of pulleys to form a coin ejecting end of the coin transporting channel;

gripping diametrically opposed edges of consecutive coins in the slots of the converging belts at the coin receiving end of the coin transporting channel;

transporting said coins between the belts along the coin transporting channel;

releasing the edges of the coins as the belts diverge at the coin ejecting end of the coin transporting channel; and moving the coin ejecting end of the coin transporting channel in a direction to effect stacking of consecutively released coins one on top of the other.

66. A method of transporting coins, comprising:

counter-rotating a pair of endless belts which converge around a first pair of pulleys to form a coin receiving end of a coin transporting channel and diverge around a second pair of pulleys to form a coin ejecting end of the coin transporting channel engaging diametrically opposed edges of consecutive coins between the converging belts at the coin receiving end of the coin transporting channel;

transporting said coins between the belts along the coin transporting channel;

disengaging the edges of the coins as the belts diverge at the coin ejecting end of the coin transporting channel;

sensing a coin being ejected from the coin ejecting end, and delivering a signal in response thereto; and moving the coin ejecting end of the coin transporting channel in a direction to effect stacking of consecutively ejected coins one on top of the other in response to said signal.

67. A method of transporting coins, comprising:

counter-rotating a pair of slotted endless belts which converge around a first pair of pulleys to form a coin receiving end of a coin transporting channel and diverge around a second pair of pulleys to form a coin ejecting end of the coin transporting channel;

gripping diametrically opposed edges of consecutive coins in the slots of the converging belts at the coin receiving end of the coin transporting channel;

transporting said coins between the belts along the coin transporting channel;

releasing the edges of the coins as the belts diverge at the coin ejecting end of the coin transporting channel;

sensing a coin being ejected from the coin ejecting end, and delivering a signal in response thereto; and moving the coin ejecting end of the coin transporting channel in a direction to effect stacking of consecutive coins one on top of the other in response to said signal.

68. A method of transporting coins, comprising:

counter-rotating a pair of endless belts which converge around a first pair of pulleys to form a coin receiving end of a coin transporting channel and diverge around a second pair of pulleys to form a coin ejecting end of the coin transporting channel;

engaging diametrically opposed edges of consecutive coins between the converging belts at the coin receiving end of the coin transporting channel transporting said coins between the belts along the coin transporting channel;

disengaging the edges of the coins as the belts diverge at the coin ejecting end of the coin transporting channel;

sensing a coin being ejected from the coin ejecting end, and delivering a signal in response thereto; and raising the coin ejecting end of the coin transporting channel by a predetermined amount in response to said signal.

69. A method of transporting coins, comprising:

counter-rotating a pair of slotted endless belts which converge around a first pair of pulleys to form a coin receiving end of a coin transporting channel and diverge around a second pair of pulleys to form a coin ejecting end of the coin transporting channel;

gripping diametrically opposed edges of consecutive coins in the slots of the converging belts at the coin receiving end of the coin transporting channel;

transporting said coins between the belts along the coin transporting channel;

releasing the edges of the coins as the belts diverge at the coin ejecting end of the coin transporting channel;

sensing a coin being ejected from the coin ejecting end, and delivering a signal in response thereto; and raising the coin ejecting end of the coin transporting channel by a predetermined amount in response to said signal.

* * * * *

UNITED STATES PATENT AND TRADEMARK OFFICE

CERTIFICATE OF CORRECTION

PATENT NO. : 5,135,435

DATED : August 4, 1992

INVENTOR(S) : James M. Rasmussen

It is certified that error appears in the above-indentified patent and that said Letters Patent is hereby corrected as shown below:

Column 10, line 3, "form" should be --from--.

Column 14, line 3, "con" should be --coin--.

Column 17, line 49, "sad" should be --said--.

Column 24, line 59, "con" should be --coin--.

Column 24, line 64, "con" should be --coin--.

Column 25, line 6, "i" should be --in--.

Column 25, line 64, after "comprising" add --:--.

Column 26, line 25, "o" should be --on--.

Signed and Sealed this

Twelfth Day of October, 1993

*Attest:*

*Attesting Officer*

BRUCE LEHMAN

*Commissioner of Patents and Trademarks*